US009326582B2

(12) United States Patent
Duru

(10) Patent No.: US 9,326,582 B2
(45) Date of Patent: May 3, 2016

(54) HEATING APPLICATION DEVICE FOR A COSMETIC PRODUCT

(75) Inventor: Nicolas Duru, Paris (FR)

(73) Assignee: L'OREAL, Paris (FR)

( * ) Notice: Subject to any disclaimer, the term of this patent is extended or adjusted under 35 U.S.C. 154(b) by 414 days.

(21) Appl. No.: 13/821,681

(22) PCT Filed: Sep. 9, 2011

(86) PCT No.: PCT/EP2011/065625

§ 371 (c)(1),
(2), (4) Date: May 14, 2013

(87) PCT Pub. No.: WO2012/032149

PCT Pub. Date: Mar. 15, 2012

(65) Prior Publication Data

US 2013/0223914 A1 Aug. 29, 2013

(30) Foreign Application Priority Data

Sep. 10, 2010 (FR) ..... 10 57205

(51) Int. Cl.

| | |
|---|---|
| ***A46B 11/08*** | (2006.01) |
| ***A45D 34/00*** | (2006.01) |
| ***A45D 40/04*** | (2006.01) |
| ***A45D 40/06*** | (2006.01) |
| ***A45D 40/08*** | (2006.01) |

(Continued)

(52) U.S. Cl.

CPC ..... *A45D 34/00* (2013.01); *A45D 40/04* (2013.01); *A45D 40/06* (2013.01); *A45D 40/08* (2013.01); *A45D 40/18* (2013.01); *A45D 34/041* (2013.01); *A45D 34/045* (2013.01); *A45D 40/265* (2013.01); *A45D 2200/155* (2013.01); *A45D 2200/157* (2013.01)

(58) Field of Classification Search

CPC ..... A45D 2200/155; A45D 2200/157
USPC ..... 401/1–2, 172
See application file for complete search history.

(56) References Cited

U.S. PATENT DOCUMENTS 6,311,868 B1 11/2001 Krietemeier et al.
8,308,383 B2 * 11/2012 Bouix et al. ..... 401/1

(Continued)

FOREIGN PATENT DOCUMENTS

FR 2 913 319 9/2008
FR 2 927 233 8/2009

(Continued)

OTHER PUBLICATIONS

International Search Report for International Patent Application No. PCT/EP2011/065624, dated Dec. 23, 2011.

(Continued)

*Primary Examiner* — Jennifer C Chiang
(74) *Attorney, Agent, or Firm* — The Marbury Law Group, PLLC

(57) ABSTRACT

An application device for a cosmetic product comprising a holding member, an application member having a surface for application of the product, and a heating electric element. The heating electric element is formed of at least one resistor mounted on a printed circuit positioned, at least in part, facing or in contact with the application member, and the surface area of the orthogonal projection of the resistor on a plane defined by the printed circuit is less than or equal to 10 mm$^2$.

18 Claims, 3 Drawing Sheets

Figure 1:
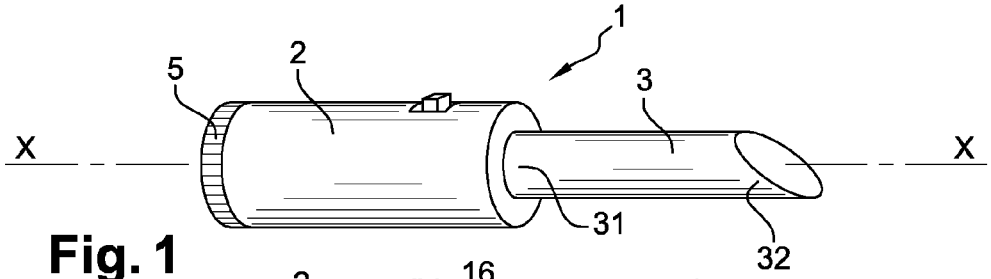

(51) Int. Cl.

| | |
|---|---|
| ***A45D 40/18*** | (2006.01) |
| *A45D 34/04* | (2006.01) |
| *A45D 40/26* | (2006.01) |

(56) References Cited

U.S. PATENT DOCUMENTS

| | | | | |
|---|---|---|---|---|
| 8,585,306 | B2 * | 11/2013 | Duru et al. | 401/1 |
| 8,864,401 | B2 * | 10/2014 | Duru | 401/265 |
| 8,950,962 | B2 * | 2/2015 | Bouix et al. | 401/1 |
| 2005/0031400 | A1 | 2/2005 | Marcotte et al. | |
| 2005/0036823 | A1 * | 2/2005 | Butcher et al. | 401/266 |
| 2008/0143214 | A1 | 6/2008 | McNamara et al. | |
| 2008/0216857 | A1 | 9/2008 | Tranchant et al. | |
| 2010/0043817 | A1 * | 2/2010 | Haan | 132/211 |
| 2011/0097133 | A1 | 4/2011 | Duru et al. | |

FOREIGN PATENT DOCUMENTS

| | | | |
|---|---|---|---|
| JP | 2010046265 | A | 3/2010 |
| JP | 2010073942 | A | 4/2010 |
| JP | 2010131366 | A | 6/2010 |
| WO | 2007143370 | | 12/2007 |
| WO | 2007143430 | | 12/2007 |
| WO | 2011015940 | | 2/2011 |
| WO | 2012032148 | | 3/2012 |

OTHER PUBLICATIONS

Written Opinion from the International Searching Authority for International Patent Application No. PCT/EP2011/065624, dated Dec. 23, 2011.

International Search Report for corresponding International Patent Application No. PCT/EP2011/065625, dated Dec. 23, 2011.

Written Opinion from the International Searching Authority for corresponding International Patent Application No. PCT/EP2011/065625, dated Dec. 23, 2011.

English translation of Japanese Office Action for JP 2013-527617, mailed Jul. 27, 2015.

* cited by examiner

HEATING APPLICATION DEVICE FOR A COSMETIC PRODUCT

This is a national stage application of PCT/EP2011/065625, filed internationally on Sep. 9, 2011, which claims priority to U.S. Provisional Application No. 61/383,380, filed on Sep. 16, 2010, as well as French Application FR 1057205, filed on Sep. 10, 2010, the entire contents each of which are incorporated by reference herein.

The present invention relates to a device for the application of a cosmetic product.

More precisely, the subject of the invention is a device comprising an applicator comprising a heating element.

"Cosmetic product" means any composition as defined in Directive 93/35/EEC of the Council of 14 Jun. 1993.

Devices exist that have application elements that it could be useful to be able to heat in a relatively uniform manner in order, for example, to make the application and/or the withdrawal of the product easier or to obtain new properties for the application.

Through application FR2913319, a device is known for the application of a cosmetic product comprising a single resistive heating element situated in the application head and supplied with electricity by means of conductors placed in the rod connecting the application head to the stopper. The heating element is a wound metal wire or a ceramic element connected by conducting wires moulded into the rod and into the application head. Consequently, a faulty heating element or electric conductor cannot be replaced once moulded into the applicator. Moreover, this type of heating element consumes a lot of energy.

Through application WO2007/143430, a device is known for the application of a cosmetic product comprising a single resistive heating element situated in an applicator end-piece and supplied with electricity by means of a flexible, costly printed circuit placed in the hollow rod connecting the application head to the retaining ring on the sleeve of the device. However, the heating element may be a resistive track of the printed circuit or a wound resistive wire which require a great length in order to obtain a sufficient heating temperature and consequently are very bulky and not very suitable for small-sized application members. These heating elements also consume a lot of energy. Moreover, a failure, such as a disconnection of the resistive wire or of the resistive track, stops the heating element from operating.

There is a need to allow the application of a cosmetic product with the aid of a heating applicator that is of relatively simple design, is reliable, takes up little space and is easily removed.

The object of the present invention is therefore to provide an improved device for the application of a cosmetic product in order to alleviate the aforementioned drawbacks.

Accordingly, the invention proposes an application device for a cosmetic product comprising a holding member, an application member having a surface for application of the product, and a heating electric element.

According to the invention, the heating electric element is formed of at least one resistor mounted on a printed circuit inserted, at least in part, in a housing of the application member, or positioned, at least in part, facing or in contact with the surface opposite to the application surface of the application member, the surface area of the orthogonal projection of the resistor on a plane defined by the printed circuit being less than or equal to 10 $mm^2$, better still less than or equal to 6 $mm^2$.

Advantageously, the invention makes it possible to obtain a device that is simple to produce, the assembly of the heating system in the applicator being carried out independently of the method for manufacturing the application member.

Moreover, the invention advantageously makes it possible to obtain a device that takes up little space that is suitable for small application members.

According to other features of the invention, the heating element may comprise at least two resistors mounted in parallel.

At least a portion of the application surface of the application member may be made of metal and/or of silicone.

The printed circuit may be rigid.

The resistors may be mounted on both faces of the printed circuit.

A heat-conducting paste or adhesive having a thermal conductivity greater than 5 $W \cdot m^{-1} \cdot K^{-1}$ can be inserted between the resistors and the application member.

The heating electric element may be formed of at least one resistor of the SMD (Surface Mounted Device) type.

The application member may comprise at least one tube forming a duct opening on the one hand on the application surface and on the other hand in a receptacle for packaging the cosmetic product so as to form a delivery duct.

The resistors may be arranged close to the tube so as to heat the delivery duct.

Figure 2:
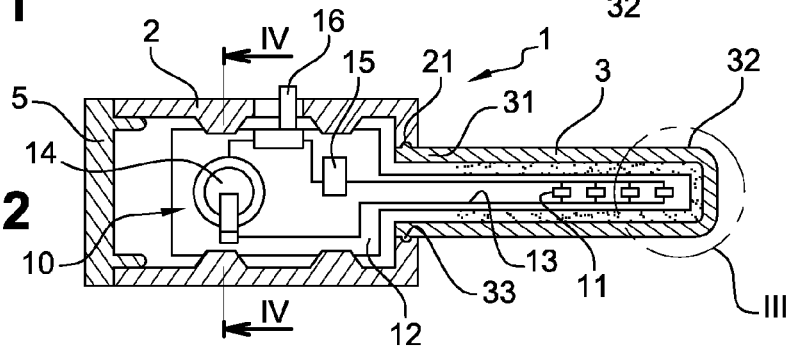
Figure 3:
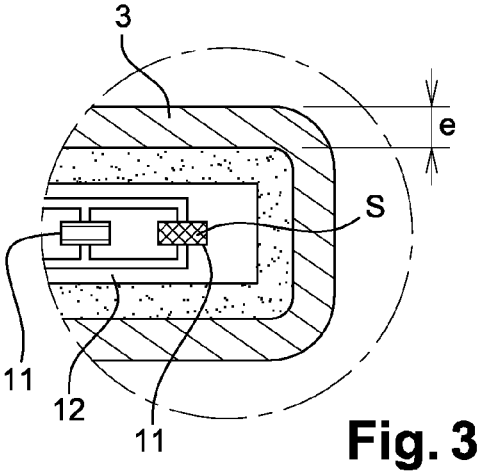
Figure 4:
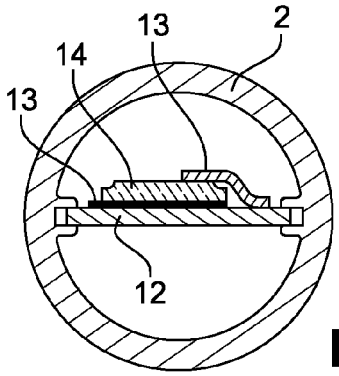
Figure 5A:
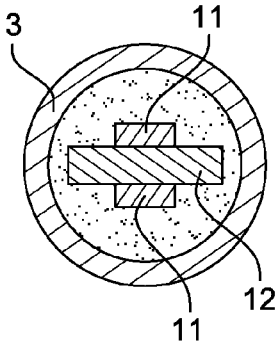
Figure 6A:
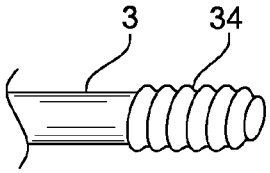
Figure 6B:
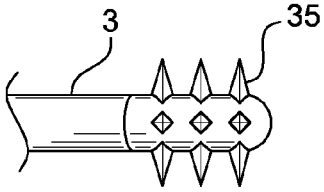
Figure 5B:
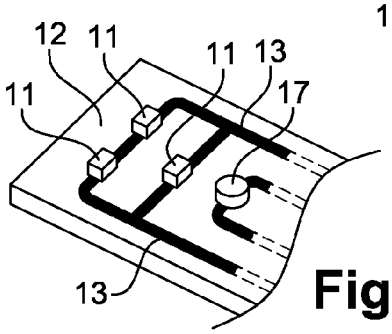
Figure 7:
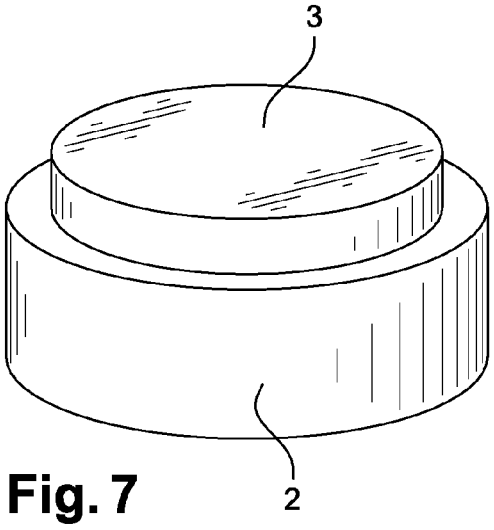
Figure 8:
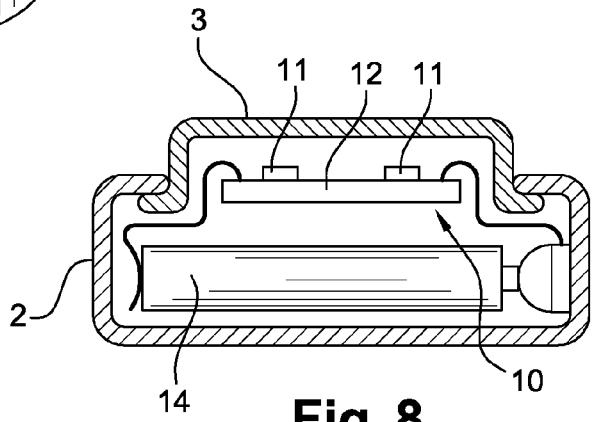
Figure 9:
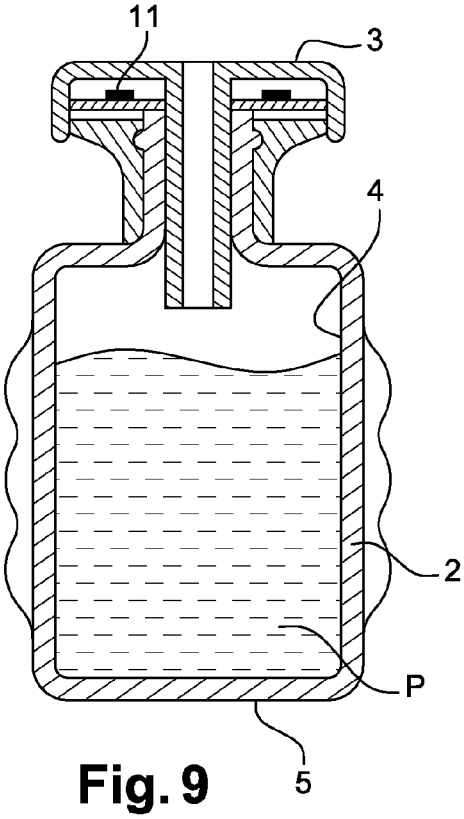
Figure 8A:
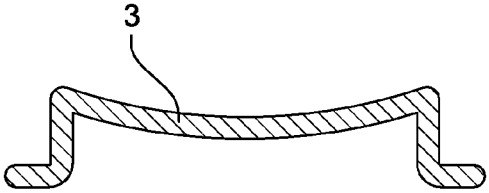
Figure 8B:
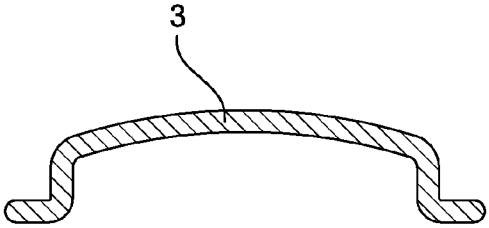
Figure 10:
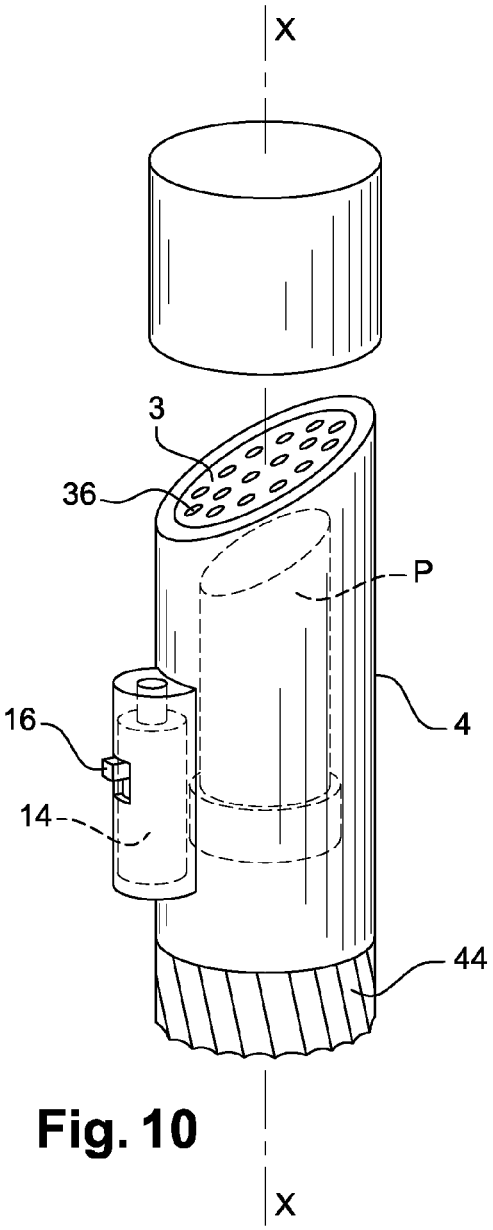
Figure 11:
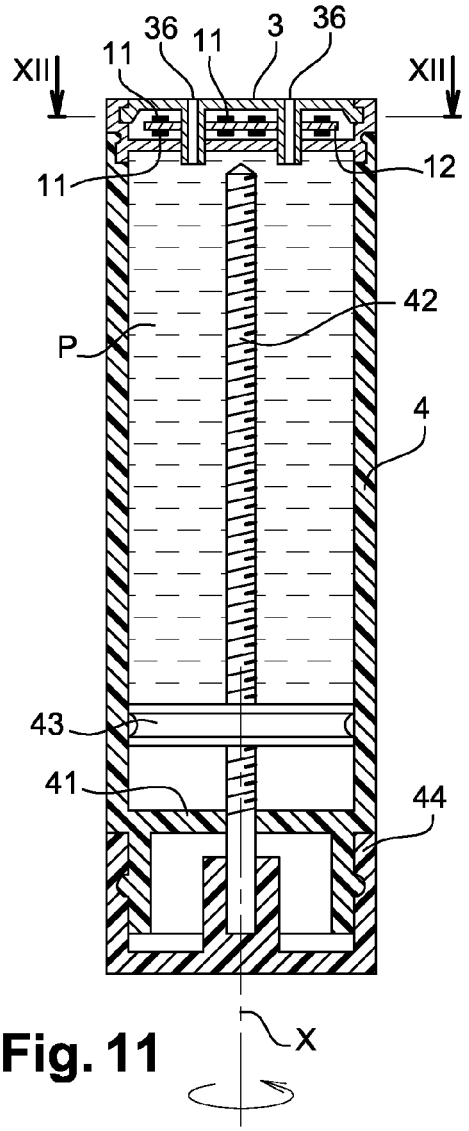
Figure 12:
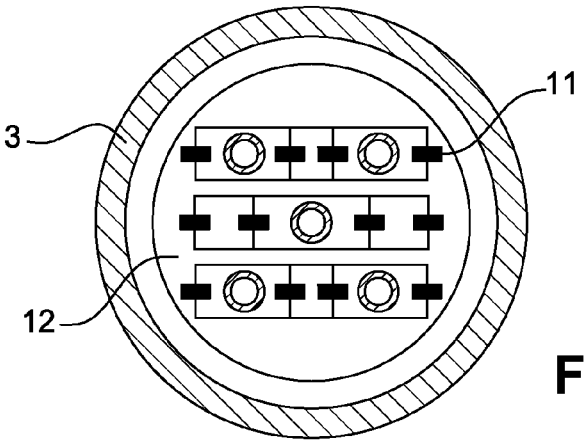

The invention will be able to be better understood on reading the following description of non-limiting exemplary embodiments of the latter, with reference to the appended drawings, in which:

FIG. 1 represents an example of a device for the application of a cosmetic product according to the invention, FIG. 2 represents a longitudinal section of the device of FIG. 1, FIG. 3 represents a detail view of FIG. 2, FIG. 4 represents a view in cross section along the axis IV-IV of FIG. 2, FIGS. 5*a* and 5*b* represent variants of the installation of the resistors of the device of FIG. 1, FIGS. 6*a* and 6*b* represent variants of the application member of FIG. 1, FIG. 7 represents a variant of the device for the application of a cosmetic product according to the invention, FIG. 8 represents a longitudinal section of the device of FIG. 8, FIGS. 8*a* and 8*b* represent variants of the application member of FIG. 7, FIG. 9 represents a longitudinal section of a variant of the device for the application of a cosmetic product according to the invention, FIG. 10 represents another variant of the device for the application of a cosmetic product according to the invention, FIG. 11 represents a longitudinal section of the device of FIG. 10, FIG. 12 represents a view in cross section along the axis XII-XII of FIG. 11.

FIG. 1 shows an example of a device 1 for the application of a cosmetic product.

This application device 1 comprises a holding member 2 and an application member 3 for a cosmetic product P. The formulation of the product P is for example suitable for being applied warm, for example at a temperature higher than 40° C., the product comprising for example ingredients that are reactive to a source of heat.

The product P is for example contained in a receptacle not shown. The application device may or may not then be adapted to be attached to this receptacle. For example, the receptacle may comprise an outlet orifice defined by a neck the outer wall of which comprises a thread that can interact with a matching thread of the holding member so that, in the closed position, the holding member forms a stopper for the receptacle and the application member is inserted into the outlet orifice so as to be situated in the receptacle.

With reference to FIGS. 1 and 2, the holding member 2 of the device is a hollow body extending mainly along a longitudinal axis X. The holding member 2 is for example cylindrical but other sectional shapes may of course be envisaged.

The holding member is closed at one end by a bottom 5. This bottom 5 is optionally removable. When the bottom 5 is removable, notably in order to be able to gain access to the inside of the holding member, it may be attached by any known removable attachment means such as by snap-fitting, screwing or sleeve-fitting.

The end opposite to the bottom 5 is designed to receive the application member 3.

Accordingly, the application member 3 is connected by its proximal end 31 to the holding member 2, for example, by the snap-fitting of a rib 33 of the application member into a groove 21 of the holding member 2. The application member may equally be connected to the holding member by any other attachment means such as a tight-fitting assembly, a bonding, a screwing, or another means.

The application member 3 may take the form of a hollow rod extending from the holding member for example along the longitudinal axis X but it may equally extend along another axis, for example parallel to the axis X.

The rod has, for example, a circular cross section; the section may equally be polygonal, oval or of any other shape.

The hollow rod 3 defines a cavity opening into the hollow holding member 2 and extending up to the distal end 32 of the application member.

The largest transverse dimension of the section of the cavity, for example the diameter when the cavity is circular, is for example between 3 and 10 mm, better still between 4 and 7 mm. The thickness e of the wall around the cavity is for example between 0.1 and 3 mm.

The surface of the distal end 32 of the application member 3 defines the surface of application of the product P and has a shape suitable for the said application. The surface may thus be adapted to the use of a cosmetic product, such as a lipstick, a lip gloss, a mascara, or a foundation. FIG. 1 shows a cylindrical application member 3 comprising a beveled distal end 32 for example for the application of a product to the lips.

The application member 3 may be entirely or partially made of metal, of silicone, of thermoplastic material or of any other material. Preferably, the application member 3 comprises a material having good thermal conductivity, that is to say greater than 1 $W \cdot m^{-1} \cdot K^{-1}$. For example, the application member may be made entirely of metal such as aluminium. It may also be partially made of thermoplastic material and its distal end 32 made of a silicone having a thermal conductivity greater than the rest of the application member. The application member may then be manufactured by a bi-injection method.

The application surface of the application member 3 may have sustained shaping and/or a surface treatment. For example, FIG. 6*a* shows an application member with a corrugated shape 34 which may for example be polished. Other shapes may also be envisaged such as striated, flattened, concave or convex shapes, and other treatments such as a flocking or a treatment designed to make the surface rough or porous.

A coating may also be placed on the application surface such as for example a sleeve optionally furnished with application elements 35.

The application elements 35 may be for example teeth illustrated in FIG. 6*b*, but the invention is not limited to such an example of application elements, nor to a particular arrangement of the application elements 35 on the application member 3. Similarly, the application elements may be fitted to the application surface notably by virtue of a sleeve, but they may also be made in one piece with the distal end 32 of the application member 3.

According to the invention, the device 1 comprises an electrical device 10 comprising a heating element 11.

The electrical device consists of a printed circuit 12 on which at least one heating resistor 11 is mounted and is connected by conductive elements and/or conductive tracks 13 of the printed circuit 12 to an electrical power supply 14.

Thus, the resistor 11 gives off heat when an electric current passes through it.

Advantageously, several heating resistors 11 are mounted on the printed circuit 12 in order to obtain a higher temperature, and/or to reach a temperature threshold more rapidly.

In order to minimize the bulk of the electrical device notably in order to miniaturize the application member, the resistors are chosen so that the surface area of the orthogonal projection S of each resistor on a plane defined by the printed circuit is less than 10 $mm^2$, or even less than 6 $mm^2$.

The resistors 11 may advantageously be of the "surface mounted device" (SMD) type. This type of rectangular parallelepipedal component has the advantage of being cheap and extremely small.

Thus a resistor of the "SMD" type of 1206 standard size has a length of approximately 3.2 mm and a width of approximately 2.5 mm. The surface area of the orthogonal projection S of the resistor on a plane defined by the printed circuit is therefore approximately 5.1 $mm^2$. Other standard sizes may be used, for example 1210, 0805, 0603, which have respectively projection surface areas of approximately 8 $mm^2$, 2.5 $mm^2$ and 1.3 $mm^2$.

The resistors of the "SMD" type also have the advantage of not having to pierce the printed circuit for mounting, and of being able to be mounted on both faces of the said circuit thus providing a reduced bulk of the electrical device.

The resistors 11 may be supplied with DC current directly by the power supply 14, or via a controller 15 regulating, for example, the intensity of the current.

Moreover, the resistors may be mounted in series or in parallel. As a variant, the resistors 11 are mounted in parallel with all or some branches comprising resistors 11 mounted in series as in FIG. 5*b*. Conversely, according to a variant not shown, the resistors 11 are mounted in series with all or some portions comprising resistors 11 mounted in parallel.

One of the advantages of a parallel mounting is to have a continuity of the electric circuit despite the failure of certain resistors or of certain branches of the circuit. In this case, a controller 15 can have failure-detection means, for example by scanning the intensity variations of the current in order to adapt the power supplied to the circuit.

The resistors 11 may be all identical but it can be otherwise. For example, it is possible to use resistors of different sizes in order to be optimized relative to the shape of the applicator, and of different resistivities in order to adapt the production of heat as a function of the zone of the applicator. In this case, it is also possible to vary the density of implantation of the resistors as a function of the heating zones in order to obtain zones with different temperatures.

Moreover, the resistors 11 are chosen so as not to absorb too great a current while having the desired temperature.

For example, it is possible to use 12 resistors of 0.5Ω placed in series and connected to a 1.5 V baton battery. The resistors are for example of the "surface mounted device" (SMD) type of the CRG series, size 1206, from the company TYCO ELECTRONICS®. This set-up makes it possible to obtain a temperature of approximately 100° C. on the application surface in two minutes for a surface area used on the printed circuit of 61 $mm^2$.

As a comparison in order to obtain the same level of heating with a resistive wire made of Nichrome®, with a diameter of 0.5 mm, a length of 150 mm and a resistivity of 22.5 $\Omega m^{-1}$, the surface area of the orthogonal projection S of the resistive wire on a plane defined by the printed circuit is therefore approximately 75 $mm^2$.

The portion of the printed circuit 12 comprising the resistors 11 is adapted to be inserted into the cavity of the application member 3.

In the example of FIGS. 1 to 5, the portion of the printed circuit 12 comprising the resistors 11 is a rectangular strip that is narrow, that is to say with a width that is less than the diameter of the cavity of the cylindrical applicator. For a cavity of 5 mm in diameter, the width of the printed circuit will for example be between 3 and 4 mm.

The resistors 11 may be installed over the whole of the length of the application member 3 but preferably the resistors 11 are situated only at the distal end 32 so as to heat only the application surface and consume only the energy necessary for the application of the cosmetic product.

Furthermore, in order to avoid affecting the release of the heat produced by the heating element, a thermal paste or adhesive having for example a high thermal conductivity, that is to say greater than 1 $W \cdot m^{-1} \cdot K^{-1}$, even better greater than 5 $W \cdot m^{-1} \cdot K^{-1}$, can be placed between the electric circuit and the inner wall of the applicator member. This paste or adhesive also makes it possible to have no air, a bad conductor of heat, between the electric circuit and the inner wall of the applicator member.

As an example, it is possible to use the adhesive referenced 707 from the company EPOTECNY® which advantageously conducts heat with a thermal conductivity greater than 1 $W \cdot m^{-1} \cdot K^{-1}$, while being electrically insulating.

The electric circuit may comprise a portion placed outside the applicator, for example the power supply can be adjacent to the holding member.

The electric circuit may comprise a switch 16 making it possible to selectively power the resistors 11 from the electric power supply 14 via the electric conductors 13.

For example, the switch 16 protrudes on the outer surface of the holding member 2 so as to be able to be actuated by the user, as shown in FIGS. 1 and 2.

The device 1 may comprise a system 15 for regulating the temperature of the application member 3, this regulation system 15 being for example a controller, installed on the printed circuit 12.

The regulation system 15 may use a programmed timer of the power supply of the heating element.

The regulation system 15 may also be connected to a temperature sensor 17 shown in FIG. 5*b*, situated close to the resistors 11 and making it possible to supply or not supply power to the heating element according to a temperature setpoint programmed in the regulation system 15. The temperature sensor is for example of the thermistor type.

A variant of a device according to the invention is shown in FIGS. 7 and 8.

This application device 1 comprises a main body 2 by which the user can hold the device. The main body is a hollow body, for example cylindrical, closed at one end by a bottom 5 that is optionally removable. The opposite end to the bottom 5 is open.

The device 1 comprises an application member 3 on which a cosmetic product P can be placed. The application member 3 forms a plate closing off the opening of the main body. This plate may comprise a peripheral skirt for attaching it to the main body. This attachment may be removable, notably in order to be able to gain access to the inside of the holding member. The attachment can be carried out by any known attachment means such as by snap-fitting, screwing or sleeve-fitting.

The plate is advantageously made of a material with high thermal conductivity, for example a metal such as stainless steel. The surface of the plate may be flat as in FIG. 7, concave as in FIG. 8*a* or convex as in FIG. 8*b*. The surface is not limited to these specified profiles but may clearly take any other form.

An electrical device is placed inside the main body. The electrical device comprises a printed circuit comprising heating resistors as described in the foregoing variant. This printed circuit is placed facing the plate so as to be able to heat the application surface. For example, the printed circuit is bonded to the plate on the surface opposite to the application surface.

The product P is, for example, contained in a receptacle not shown. For the use of this device, the user takes product on her fingers and carries it to the heating application surface so as to heat the product. The user can then apply the heated product to the desired location, either with her fingers or with the device by applying the application surface comprising the heated product directly to her skin. In this case, the application surface may have reliefs making it possible to massage the skin notably in order to improve the application.

Another variant of a device according to the invention is shown in FIG. 9.

This application device 1 comprises a receptacle 2. The receptacle is a hollow body closed at one end by a bottom 5. The opposite end comprises a neck defining a delivery orifice for a product P contained in the receptacle.

The device 1 comprises an application member. The application member is a plate forming an application surface having an orifice.

The application surface may have reliefs making it possible to massage the skin notably in order to improve the application.

The plate comprises a cylindrical skirt around the orifice extending axially away from the application surface. This cylindrical skirt has an external diameter that is substantially equal to the diameter of the delivery orifice of the receptacle. Thus, the cylindrical skirt can be sleeve-fitted into the delivery orifice so as to form a duct leading on the one hand into the receptacle and on the other hand onto the application surface through the orifice of the plate.

An electrical device is placed facing the plate on the side opposite to the application surface. The electrical device is for example bonded to the plate.

This electrical device comprises a printed circuit comprising heating resistors as described in the foregoing variants so as to be able to heat the application surface.

This printed circuit has a hole allowing the circular skirt of the plate to pass in the direction of the receptacle.

An intermediate part may be attached to the edge of the plate comprising for example a peripheral skirt, and to the neck of the receptacle. The attachment can be carried out by any known attachment means such as by snap-fitting, screwing or sleeve-fitting.

The electrical device is then held between the intermediate part and the plate.

The plate is advantageously made of a material with high thermal conductivity, for example a metal such as stainless steel.

The product P may flow through the delivery duct by the effect of gravity when the delivery orifice is pointing downwards. In the case of a receptacle with flexible walls, the product may also flow through the delivery orifice by pressing the walls of the receptacle so as to reduce its internal volume and to thus expel the product P through the delivery orifice onto the application surface.

The user may then apply the heated product to the desired location by applying the application surface comprising the product.

Another variant of a device according to the invention is shown in FIGS. 10 to 12.

This device 1 for delivering a product P of liquid, pasty or solid consistency, such as a lipstick composition, comprises a reservoir 4 of generally cylindrical shape containing the product P. The reservoir 4 comprises on its top portion an application end-piece 3.

This application end-piece 3 has an application surface comprising a multitude of delivery orifices 36 in communication with the reservoir 4.

The device comprises a mechanism for moving the product P.

For example, the mechanism may be a pushing mechanism or a rotation mechanism. The device shown comprises a rotation mechanism.

The reservoir 4 comprises a circular bottom 41 furnished with a central hole traversed by a threaded control rod 42. A piston 43 comprising an internally threaded passageway is mounted on the threaded rod 42, this piston being capable of sliding in translation inside the reservoir 4 under the action of the rotation of the control rod 42 so as to cause the expulsion of the product P. The rod 42 is actuated by a control thumbwheel 44 mounted so as to rotate freely on a cylindrical skirt supported by the bottom 41. The thumbwheel 44 comprises a central shaft of cylindrical shape in which a free end of the rod 42 is attached. The thumbwheel 44 also comprises a cylindrical skirt surrounding the skirt supported by the bottom 41. The skirts are furnished with a snap-fitting system consisting of an annular rib/annular swelling pair interacting with one another so that the thumbwheel 44 remains free in rotation.

According to the invention, the end-piece comprises a heating electrical device which makes it possible to heat the portion of product in contact with the heating element prior to the application of the product onto the keratinous materials, for example the skin or the lips.

The end-piece is formed of a plate comprising orifices and ducts extending axially away from the application surface and leading on the one hand into the receptacle and on the other hand onto the application surface through the orifice of the plate.

An electrical device is placed facing the plate on the side opposite to the application surface.

This electrical device comprises a printed circuit comprising heating resistors as described in the foregoing variants so as to be able to heat the application surface.

This printed circuit has holes corresponding to the orifices of the plate allowing the ducts of the plate to pass in the direction of the receptacle.

An intermediate part also pierced is attached between the receptacle and the printed circuit.

The heating element therefore makes it possible to heat a portion of product in the receptacle to a depth of less than 5 mm, while heating the product in the ducts and on the application surface.

The heating element 10 is connected to an electrical power-supply source 14 housed for example in the main body 4 which may, for example, comprise a suitable housing on its peripheral surface as shown in FIG. 10.

The heating end-piece comprises orifices through which the product P which has softened and therefore become viscous or fluid under the effect of the heat can pass easily while it could not do so or could do so with difficulty in solid or pasty form.

The number of orifices may be between 2 and 100 and their section may be less than 5 $mm^2$ or even less than 2 $mm^2$ or yet less than 1 $mm^2$.

This device also makes it possible to save on the energy stored in the electrical power-supply source by heating only the quantity of product necessary, for example, for application on the lips or the skin.

The invention is not limited to the examples illustrated. The features of the various examples may notably be combined within variants that are not illustrated.

The expression "comprising a" must be understood to mean "comprising at least one", unless specified to the contrary.

The invention claimed is:

1. An application device for a cosmetic product comprising:

a holding member, an application member having a surface for application of the product, and a heating electric element;

wherein the heating electric element is formed of at least one resistor mounted on a printed circuit positioned, at least in part at a distal end of the application member, and in that a surface area of the orthogonal projection of the resistor on a plane defined by the printed circuit is less than or equal to 10 $mm^2$.

2. The application device of claim 1, wherein the surface area of the projection is less than or equal to 6 $mm^2$.

3. The application device of claim 1, wherein the heating element comprises at least two resistors mounted in parallel.

4. The application device of claim 1, wherein at least a portion of the application surface of the application member is made of metal or of silicone.

5. The application device of claim 1, wherein the printed circuit is rigid.

6. The application device of claim 5, wherein the resistors are mounted on both faces of the printed circuit.

7. The application device of claim 1, wherein a heat-conducting paste or an adhesive having a thermal conductivity greater than 5 $W \cdot m^{-1} \cdot K^{-1}$ is positioned between the resistors and the application member.

8. The application device of claim 1, wherein the heating electric element is formed of at least one resistor of the Surface Mounted Device type.

9. The application device of claim 1, wherein the application member comprises at least one tube, the tube forming a delivery duct between the application surface and a receptacle for packaging the cosmetic product, the tube having a first opening on the application surface and a second opening in the receptacle for packaging the cosmetic product.

10. The application device of claim 9, wherein the resistors are arranged close to the tube so as to heat the delivery duct.

11. The application device of claim 1, further comprising a connection structure configured to connect the application device to a receptacle for containing the cosmetic product.

12. The application device of claim 11, wherein the connection structure comprises a threaded portion of the holding member.

13. The application device of claim 1, wherein the holding member and application member are configured to connect to one another via a snap-fit connection.

14. The application device of claim 1, wherein the holding member comprises a hollow body and the application member comprises a plate connected to the hollow body.

15. A packaging and application device for a cosmetic product, comprising:

a reservoir configured to contain a cosmetic product;

a translation mechanism for moving a product within the reservoir;

an application member including orifices to permit the product to exit the reservoir onto an application surface of the application member, the application surface configured for application of the product to a keratinous surface; and a heating electric element;

wherein the heating electric element is formed of at least one resistor mounted on a printed circuit positioned, at least in part, facing or in contact with a surface opposite to the application surface of the application member so as to heat a portion of the product contained in an upper portion of the reservoir.

16. The device of claim 15, wherein the reservoir contains a cosmetic product.

17. The device of claim 15, wherein the translation mechanism is configured to move a product within the reservoir along a longitudinal axis of the reservoir toward the upper portion of the reservoir.

18. The device of claim 17, wherein the translation mechanism is one of a rotational mechanism and a piston mechanism.

* * * * *